United States Patent [19]

Jentzsch et al.

[11] 4,442,775

[45] Apr. 17, 1984

[54] DEVICE FOR ADJUSTING AN INK KNIFE IN AN INK-APPLICATOR OF A PRINTING MACHINE

[75] Inventors: Arndt Jentzsch, Coswig; Hans Johne, Radebeul; Wolfgang Müller, Coswig, all of German Democratic Rep.

[73] Assignee: Veb Kombinat Polygraph "Werner Lamberz", Leipzig, German Democratic Rep.

[21] Appl. No.: 424,988

[22] Filed: Sep. 27, 1982

Related U.S. Application Data

[63] Continuation-in-part of Ser. No. 412,859, Aug. 30, 1982.

[30] Foreign Application Priority Data

Aug. 31, 1981 [DD] German Democratic Rep. ... 232885

[51] Int. Cl.[3] ..... B41F 31/02

[52] U.S. Cl. ..... 101/365

[58] Field of Search ..... 101/365, 350, 363

[56] References Cited

U.S. PATENT DOCUMENTS

| | | | |
|---|---|---|---|
| 270,886 | 1/1883 | Bittenbender | 101/365 |
| 436,847 | 7/1890 | Cormack et al. | 101/365 |
| 4,050,380 | 7/1977 | Pfizenmaier | 101/365 |
| 4,344,360 | 8/1982 | Jeschke et al. | 101/365 |

FOREIGN PATENT DOCUMENTS

| | | | |
|---|---|---|---|
| 863346 | 1/1953 | Fed. Rep. of Germany | 101/365 |
| 2928079 | 1/1981 | Fed. Rep. of Germany | 101/365 |

*Primary Examiner*—Edgar S. Burr
*Assistant Examiner*—David A. Wiecking
*Attorney, Agent, or Firm*—Michael J. Striker

[57] ABSTRACT

A device for adjusting an ink knife relative to a ductor roller in an ink-applicator of a printing machine is disclosed. The device includes an number of adjusting arrangements arranged lengthwise of the ductor roller to control a plurality of ink zones along the length of the roller, each arrangement including a pivotable lever actuated to move a stripped edge of the ink knife to and from the ductor roller, and a tension spring extended somewhat normally to the ink knife and between the ink knife and a supporting element rigidly connected to the housing of the ink applicator, the tension spring locking the lever in its selected adjusted position. The device substantially reduces mutual influence of adjacent ink zones on each other during the adjusting operation.

4 Claims, 3 Drawing Figures

DEVICE FOR ADJUSTING AN INK KNIFE IN AN INK-APPLICATOR OF A PRINTING MACHINE

CROSS-REFERENCE TO RELATED APPLICATION

This application is a Continuation-in-Part application of our copending application Ser. No. 412,859, filed Aug. 30, 1982 and entitled: DEVICE FOR ADJUSTING THE INK METER ON INK BOXES OF PRINTING PRESSES.

BACKGROUND OF THE INVENTION

The present invention relates to ink-application arrangements for printing machines in general, and more particularly to a device for adjusting the position of an ink knife relative to an ink pickup roller to adjust a passage for an ink contained in an ink reservoir.

Adjusting devices for adjusting the thickness of ink zones along the length of the ink pickup roller are known in the art. Those devices normally include a number of adjusting elements arranged lengthwise of the ink pickup roller and operated to move the stripped edge of the ink knife to and from the ink pickup roller to thereby adjust the ink zones formed between that stripped edge and the circumferential surface of the ink pickup roller.

For example, the patent DD-PS No. 139 114 discloses a device for adjusting an ink knife relative to the ink pickup roller including angle levers pivotally supported in the housing of the ink applicator. One arm of such a lever bears against the ink knife whereas the second arm of the lever is actuated by a respective set screw of a screw-type setting arrangement.

The disadvantage of this otherwise satisfactory device is that due to set-back forces exerted on the ink knife the mutual influences on the neighboring ink zones caused by the action of adjacent set screws can not be avoided.

Furthermore, with conventional motion-transmitting elements translating the motion of the setting screw into the motion of the ink knife, an accurate reproducible adjusting of the ink zones is impossible because reversing plays occur within transmitting elements during the changing of the positions of those elements.

The patent DE-AS No. 1 243 696 shows a device in which the set screws actuate the ink knife in the proximity of its lower edge through a lever. In this design, transverse pins coupled to the lower side of the ink knife by a form-locking connection engage the lever with their opposite ends. Although this device in part avoids the mutual influence of adjacent ink zones on each other because the ink knife is adjusted at both sides thereof, reversing plays occuring in the motion-transmitting elements, when their positions are changed, can not be eliminated.

SUMMARY OF THE INVENTION

It is therefore an object of the present invention to provide a device for adjusting ink zones, which avoids the above mentioned disadvantages of conventional arrangements of the foregoing type.

Still another object of the invention is to provide an improved device for adjusting the ink knife in an inking mechanism of a printing press, which ensuresan accurate adjustment of the ink zones of a predetermined thickness along the whole length of the ink pickup roller.

Still a further object of the invention is to provide a device which is easy in operation amd simple in design and which contributes to the quality of means for pressing the ink knife against the ductor roller.

Yet another object of the invention is to provide a device for adjusting an ink knife in the ink applicators in printing machines, which provides for very accurate adjustment of all ink zones without mutual influence of the adjacent zones on each other.

A further object of the invention is to provide an adjusting device in which all the plays in the motion-transmitting elements caused by their functions or wear are eliminated.

These and other objects of the invention are attained by a device for adjusting an ink knife of an ink-applicator of a printing machine, comprising a plurality of adjusting means positioned below the ink knife successively one after another lengthwise of a ductor roller of the ink applicator and operated to forcefully move a stripped edge of the ink knife to and from the ductor roller to adjust a plurality of ink zones between said stripped edge and a circumferential surface of the ductor roller, said ink applicator having a housing, said adjusting means comprising a pivotable lever having a first arm operatively connected to said stripped edge and a second arm; actuating means operatively connected to said second arem and adapted to pivot said lever in said housing so that its motion is translated into the motion of said ink knife to adjust a respective position thereof, a support element rigidly connected to said housing; and a tension spring interconnected between said stripped edge and said support element and extended substantially perpendicular to said ink knife, said tension spring locking said lever in its adjusted position.

The actuating means may include a turnable spindle provided with a cam, and a self-aligning bearing mounted on said second arm and cooperating with a cam surface of said cam upon turning movement of the spindle.

The second arm may be provided with a pin outwardly extended therefrom.

The device may further comprise a guide member connected to the housing of the ink-applicator and operative for guiding said pin in the pivoting motion of the lever.

The device may further include a mounting ear rigidly connected to a lower side of the ink knife, said tension spring being connected to the mounting ear.

In accordance with another modification of the invention the lever may have a fork-shape, said supporting element being arranged centrally between two portions of the fork.

In short, the design according to the invention combines the advantages of the structure having an ink knife not divided into a plurality of portions with the advantages of the arrangement performing separate adjustments of portions of the divided ink knife, both of which are known in the art.

The approximation of the adjustment of the adjacent ink zones is not required because the position of the ink knife on the adjusting element is warranted.

The novel features which are considered as characteristic for the invention are set forth in particular in the appended claims. The invention itself, however, both as its construction and its method of operation, together with additional objects and advantages thereof, will be best understood from the following description of specific embodiments when read in connection with the accompanying drawing.

DETAILED DESCRIPTION OF THE PREFERRED EMBODIMENTS

Figure 1:
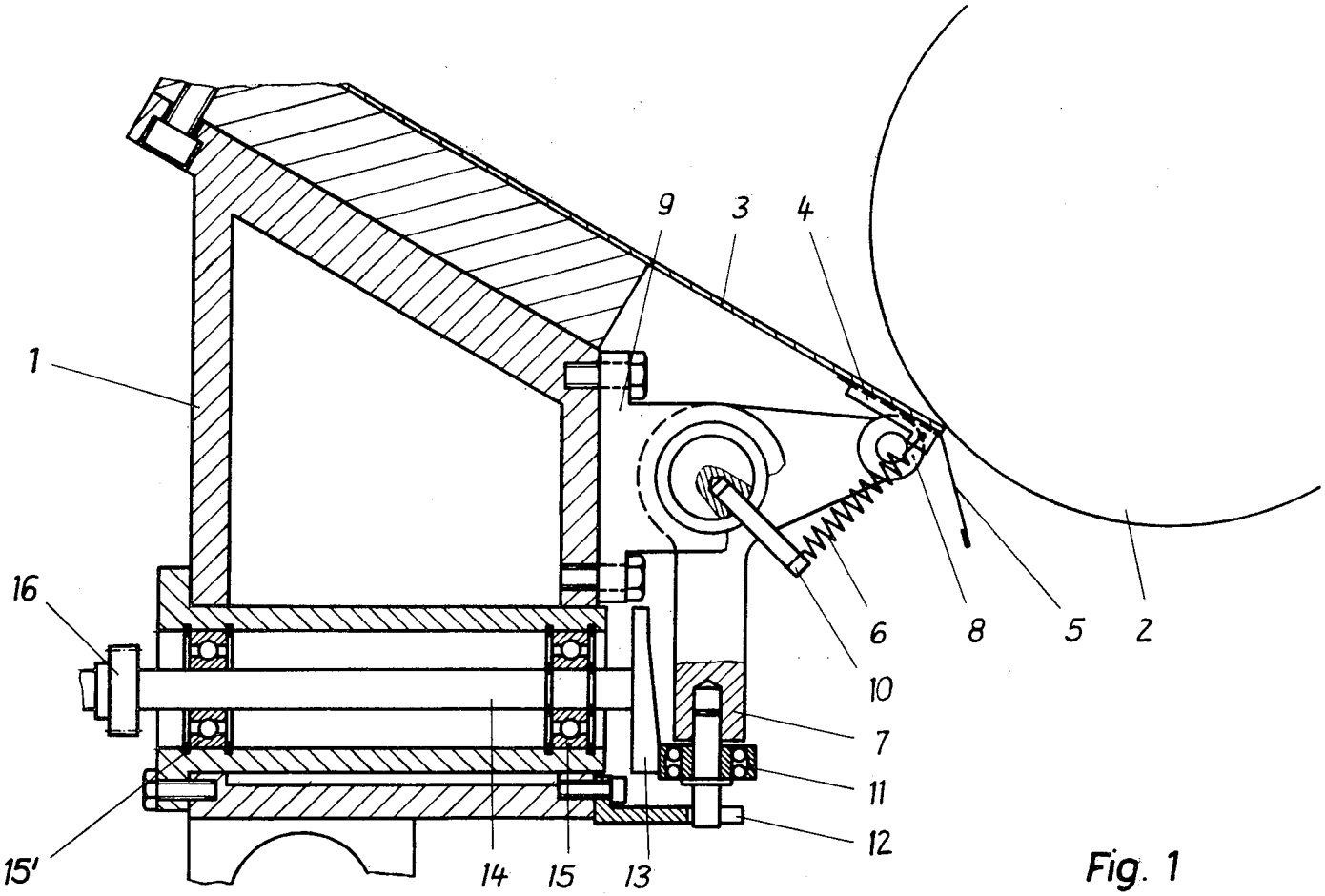
FIG. 1 is a partial sectional side view of a device for adjusting an ink knife according to the invention.

Referring now to the drawings, and first to FIG. 1, it can be seen that a firm ink knife or blade 3 is mounted to a housing of an ink applicator 1 so that a strip-like edge 30 of the ink knife forms with the circumferential surface of a ductor roller 2 one or a plurality of ink zones. A screen 5 protecting the ink zone against contamination is arranged immediately below the stip-like edge 30. A body ink is held in a reservoir formed in part by the ink knife 3 and one side of which is defined by the surface of the ductor roller 2 in a conventional fashion.

The spacing between the stripped edge 30 and the circumferential surface of the ductor roller determines the thickness of the coating of ink picked up by the roller 2 as it rotates about its central axis in a conventional manner.

An adjusting arrangement according to the invention will be explained in detail below. It should be understood, however, that a plurality of analogous arrangements are disposed below the ink knife successively in a row lengthwise of the ductor roller to adjust a plurality of adjacent ink zones formed between the stripped edge of the ink knife and the surface of the ductor roller.

Below the ink knife 3 and spaced from the ink zone there if provided a tilting lever 7 which is pivotally mounted in a support 9 rigidly connected to the housing 1. Lever 7 is provided at the end of its shorter arm *7a* with a roller 8 which is adapted to press against the lower edge of the strip-like edge of the ink knife. The longer downwardly extended arm *7b* of lever 7 is provided with a pin 20 which extends outwardly therefrom, the end of the pin being guided in a guide 12 mounted to the housing. Pin 20 of the lever 7 is provided with a self-aligning bearing 11.

A tension spring 6, which extends normal to the ink knife, is interconnected between a ear 4 coupled to the ink knife and a supporting rod 10 which is rigidly connected to the support 9 in this embodiment of the invention.

Self-aligning bearing 11 bears against a cam surface 32 of a cam 13 which is rigidly supported on an adjusting spindle 14 journalled in two opposite ball bearings 15 and 15'. Outside the housing 1 there is provided a gear 16 connected to the adjusting spindle 14 for actuating thereof and also connected to a remote control which is conventional and therefore not illustrated in the drawings. Gear 16 may, in one of the modifications of the devices, be connected with a usual rotary button for operating by hand. Alternately, both the remote control and a rotary button may be utilized for rotating the adjusting spindle 14.

Figure 2:
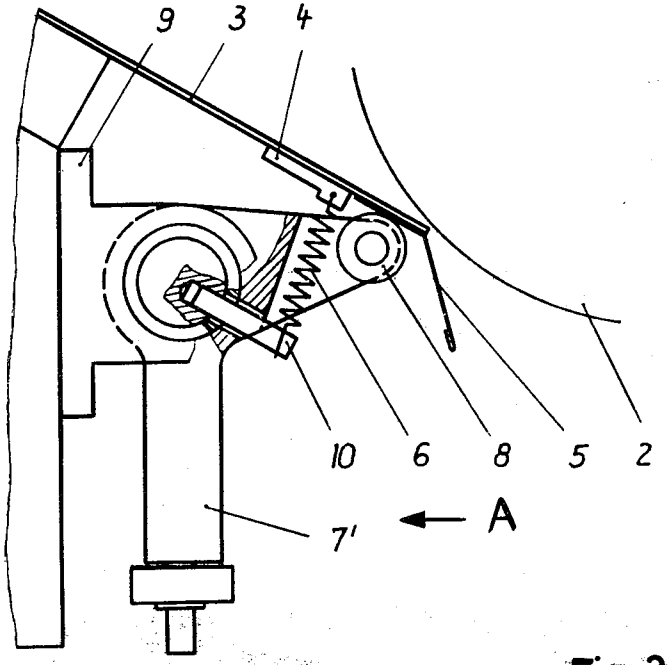
FIG. 2 is a side view, partially in section, of the adjusting device in accordance with another embodiment of the invention.
Figure 3:
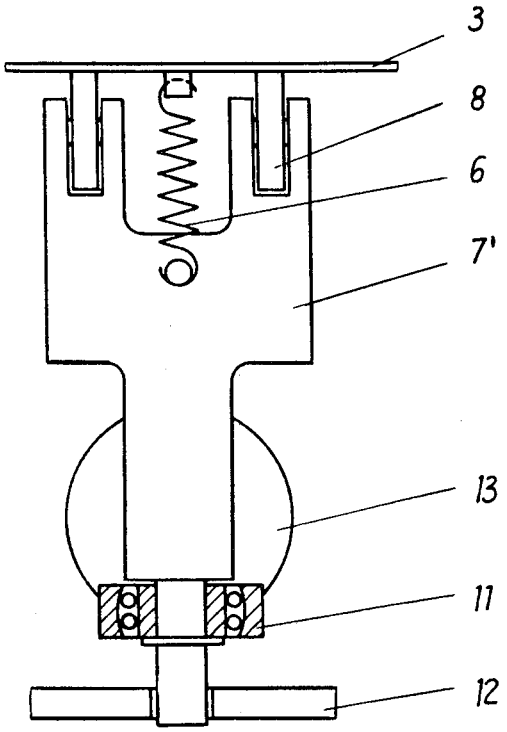
FIG. 3 is a view, partially in section, of the embodiment of FIG. 2 seen from arrow A of FIG. 2.

In the embodiment illustrated in FIGS. 2 and 3 the tilting lever 7 may be fork-shaped whereby the tension spring 6 is guided centrally of the fork-like portion of the lever 7. Thereby the transverse bending of the ink knife within the adjacent ink zones will be minimized. It is understood, of course, that the remaining components of the adjusting device shown in FIG. 2 are analogous to those of FIG. 1.

The adjusting device according to the invention operates in the following fashion:

Upon the rotation of the gear 16 spindle 14 will rotate the cam 13 whose cam surface abutting against the outer surface of the self-aligning bearing 11 will move the latter in a respective selected direction. The force acting on the tilting lever 7 via the self-aligning bearing 11 will be transmitted through the roller 8 to the strip-like edge 30 of the ink knife. Roller 8 is utilized in the device of the invention to substantially reduce friction between the ink knife and the adjusting element during the adjusting of the ink knife. Tension spring 6 extended between the ink knife 3 and the supporting rod 10 ensures the fact that each movement of the tilting lever 7 is translated into a respctive motion of the ink knife 3 and the desired control value of the ink zone will be obtained. The design of the device according to the invention exludes the possibility of mutual influence of adjacent ink zones on each other within the normal adjustment range.

Furthermore, it should be understood that motion-transmitting elements 8, 7, 11, 13, 14, 15 are always loaded in one and the same direction with the force of the tension spring so that in each position of the adjusting spindle 14 all the link plays caused by the operation or wear are squeezed out from the transmitting elements 7, 8, 11, 13, 14, 15 during the change of the direction of the adjustment.

Guide 12 prevents the tilting lever 7 from lateral displacement.

It will be understood that each of the elements described above, or two or more togehter, may also find a useful application in other types of devices for adjusting an ink knife in an ink applicator of a printing machine differing from the types described above.

While the invention has been illustrated and described as embodied in a device for adjusting an ink knife in an inkapplicator of a print machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A device for adjusting an ink knife of an inkapplicator of a printing machine, comprising a plurality of adjusting means positioned below the ink knife successively one after another lengthwise of a ductor roller of the ink applicator and operated to forcefully move a stripped edge of the ink knife to and from the ductor roller to adjust a plurality of ink zones between said stripped edge and a circumferential surface of the ductor roller, said ink applicator having a housing, said adjusting means each comprising a pivotable lever having a first arm operatively connected to said stripped edge and a second arm; actuating means operatively connected to said second arm and adapted to pivot said lever in said housing so that the motion of the lever is translated into the motion of said ink knife to adjust a respective position thereof; a support element rigidly connected to said housing; and a tension spring interconnected between said stripped edge and said support element and extended substantially perpendicular to said ink knife, said tension spring biasing said lever in its adjusted position; said second arm being provided with a pin outwardly extended therefrom and carrying a self-aligning bearing, said actuating means including a usable spindle provided with a cam having a cam surface, said self-aligning bearing cooperating with said cam surface upon turning movement of said spindle.

2. The device as defined in claim 1, including a guide member connected to said housing and operative for guiding said pin in said pivoting motion of said lever.

3. The device as defined in claim 2, further including a mounting ear rigidly connected to an end and at a lower side of said ink knife, said tension spring being connected to said mounting ear.

4. The device as defined in claim 3, wherein said lever has a fork-like shape, said tension spring being arranged centrally between two portions of the fork-like lever.

* * * * *